United States Patent [19]

Martin

[11] 4,066,275

[45] Jan. 3, 1978

[54] SKI BRAKE

[76] Inventor: Hans Martin, Chasernweg 7, Kloten, Switzerland

[21] Appl. No.: 659,255

[22] Filed: Feb. 19, 1976

[30] Foreign Application Priority Data

| | | |
|---|---|---|
| Feb. 21, 1975 | Switzerland | 2191/75 |
| Mar. 24, 1975 | Switzerland | 3735/75 |
| Apr. 24, 1975 | Switzerland | 5250/75 |

[51] Int. Cl.[2] ..... A63C 7/10

[52] U.S. Cl. ..... 280/605

[58] Field of Search ..... 280/605, 604, 601, 610

[56] References Cited

U.S. PATENT DOCUMENTS

| | | | |
|---|---|---|---|
| 3,724,867 | 4/1973 | Hawthorne | 280/605 |
| 3,940,158 | 2/1976 | Wehrli | 280/605 |
| 3,964,760 | 6/1976 | Riedel | 280/605 |
| 3,989,271 | 11/1976 | Riedel | 280/605 |

*Primary Examiner*—Joseph F. Peters, Jr.
*Assistant Examiner*—David M. Mitchell
*Attorney, Agent, or Firm*—Roylance, Abrams, Berdo & Kaul

[57] ABSTRACT

A ski brake movable by a ski boot includes a U-shaped spring and lever member connected to pivot rods which extend outwardly beyond the edges of the ski. The spring member is inwardly and outwardly deformable. The bracket includes cam surfaces which deform the arms of the spring member when the boot presses the member downwardly, drawing the rods inwardly and rotating brake arms to positions substantially parallel with and above the bottom surface of the ski. When the boot heel is lifted, the spring lowers the brake arms so that they protrude below the bottom surface of the ski. In another embodiment, the cam surfaces are between the legs of the U, and are oppositely sloped, forcing the legs apart when the boot presses the spring portion to the top surface of the ski. In a further embodiment, each brake arm is provided with a second brake arm portion pivotally connected to the first. Webs can be connected between the two brake arms to further increase the effective braking area.

14 Claims, 8 Drawing Figures

Fig. 1
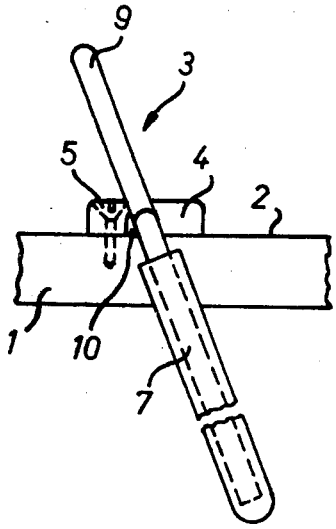
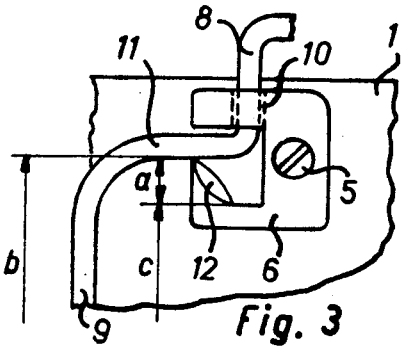
Fig. 3
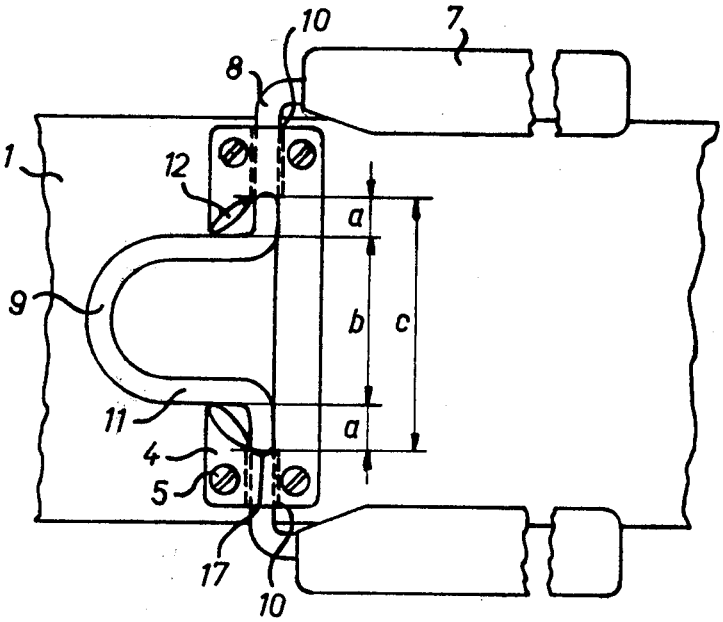
Fig. 2

Fig. 7
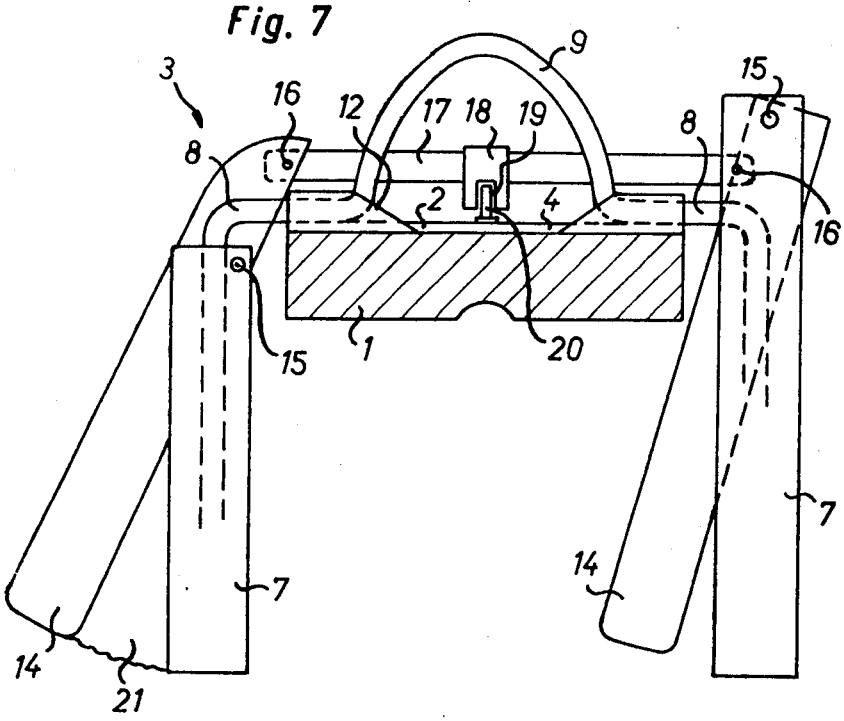
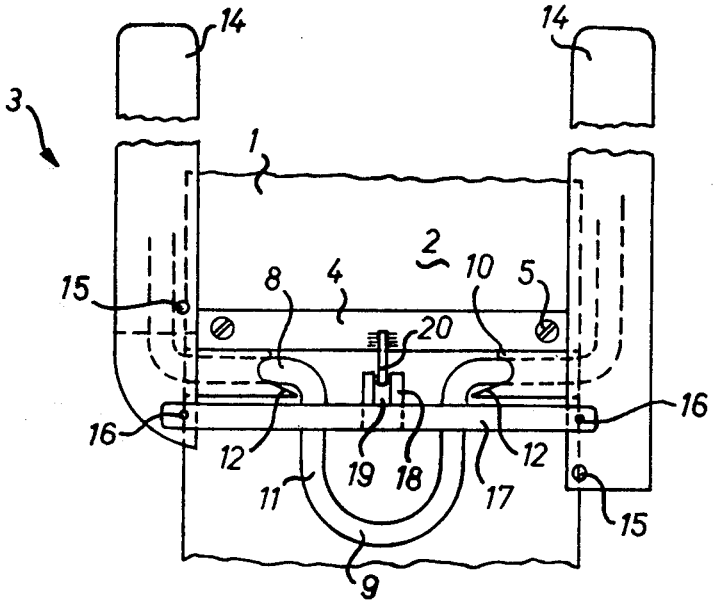
Fig. 8

SKI BRAKE

This invention relates to ski brakes and, more particularly, to ski brakes having brake arms which are held in a retracted position by the downward pressure of a ski boot when in the usual binding, the brake being operative when the boot is lifted above the top surface of the ski.

BACKGROUND OF THE INVENTION

Ski brakes of the general type to which the present application is directed are known in other forms. Reference is made to U.S. Pat. Nos. 3,884,487 and 3,940,158, which illustrate known constructions, the former one of these disclosing a structure with two brake arms positioned on opposite sides of the ski and pivotable about pivot pins which extend at right angles to the longitudinal direction of the ski. The brake arms are maintained in a neutral position, in which they exert no braking action, by the downward pressure of a ski boot when the boot is in the usual ski binding. For this purpose, oppositely directed stirrup portions are provided on the brake arms, the portions projecting into the area of the ski binding and being located beneath the sole of the ski boot in the neutral position of the brake arms. To assure that the brake arms automatically pivot into the braking position on removal of the ski boot from the binding, energy is stored by the elastic deformation of the resilient retaining stirrup when it is pressed into the neutral, non-braking position, and this reserve of stored energy is used to pivot the brake arm into the braking position when the boot is lifted.

A disadvantage of this structure is that the amount of the braking force is not precisely predetermined and, in addition, the force is smallest in the braking position, making a displacement of the brake arm relatively easy.

BRIEF SUMMARY OF THE INVENTION

An object of the present invention is to provide a ski brake of the general type described above wherein the reserve of stored resilient energy is precisely definable and wherein the brake arm is substantially positively locked in the braking position.

Briefly described, the invention includes a ski brake for a ski of the type having a top surface, a bottom contact surface and a ski boot binding on the top surface, the brake comprising the combination of at least one brake arm, a pivot pin for supporting the brake arm, bracket means mounted on the top surface of the ski for rotatably supporting the pivot pin so that the pin is rotatable between a first position in which the brake arm is substantially parallel with and above the bottom contact surface of the ski and a second, braking, position in which the brake arm extends downwardly beyond the bottom surface. The brake further includes resilient laterally deformable spring means connected to the pivot pin for urging the pivot pin up laterally relative to the central longitudinal axis of the ski, said spring means having a lever arm portion contactable by a ski boot in the binding, the lever arm portion being adjacent the top surface of the ski when the pivot pin is in the first position and which extends upwardly from the top surface when the pin is in the braking position, and means on the bracket means defining a cam surface having a slope relative to the axis of rotation of the pin for cooperating with the spring means to laterally deform the spring means when the pin and brake arm are rotated toward the first position when a ski boot depresses the lever arm and to permit the lateral urging of the spring means to rotate said pin and said arm toward the braking position when the lever arm is released.

In order that the manner in which the foregoing and other objects are attained in accordance with the invention can be understood in detail, particularly advantageous embodiments thereof will be described with reference to the accompanying drawings, which form a part of this specification, and wherein:

FIG. 1 is a partial side elevation of a ski having a ski brake in accordance with the invention fixed to the top thereof in the braking position;

FIG. 2 is a plan view of the ski brake of FIG. 1;

FIG. 3 is a partial plan view of a further embodiment of the brake of FIGS. 1 and 2 in which the spring deformation correction is opposite from FIG. 2;

FIG. 7 is an end elevation, in section, of a further embodiment of a ski brake according to the invention, shown in the braking position; and FIG. 8 is a partial plan view of the embodiment of FIG. 7 with the brake in the neutral, non-braking position.

Figure 4:
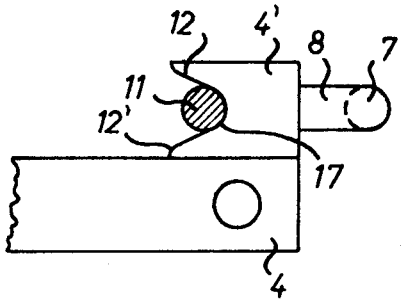
FIG. 4 is an enlarged partial plan view of the bracket supporting plate of FIG. 2.

Referring first to FIGS. 1 and 2, there is shown a ski 1 having a top surface 2 on which is pivotally mounted a ski brake indicated generally at 3 which is operatively retained on the ski by a supporting plate or bracket 4. Supporting plate 4 is secured to the ski such as by screws 5 and is either in the form of a web extending across the width of the ski at right angles thereto, or is separated into two portions as in the case of the embodiment of FIG. 3.

The ski brake 3 includes either one or two brake arms 7, pivot pins or rods 8, and a retaining stirrup or spring member 9 which can comprise a generally U-shaped spring steel wire rod having generally parallel leg portions and a central spring portion. Pivot pins 8 are journaled in and pass through recesses 10 which are formed by arcuate deformation of the metal member forming the supporting plate, as will be further shown. As shown in FIGS. 2 and 3, stirrup 9 interconnects the pivot pins 8 which are fixedly attached to or integrally formed with legs 11 of the U-shaped portion.

A critical aspect of the present invention is that the resilience for pivoting the brake arms into the braking position is produced by deformation of arms 11 transversely with respect to the ski, i.e., at right angles to the longitudinal direction of the ski. By this movement, pivot pins 8 are moved parallel with their longitudinal axes and perpendicular to the longitudinal axis of the ski. In order to accomplish this movement, a cam or control surface 12 is provided on the supporting bracket 4, or on such bracket 6 as shown in FIG. 3, the cam surface being inclined and at right angles to the longitudinal direction of the ski so that this surface is engaged by one of legs 11 in the vicinity of the transition of the leg into pivot pin 8. It will be observed that a cam surface is provided for each one of the legs so that when the U-shaped spring member extends upwardly from the top surface of the ski as in FIG. 1, legs 11 are separated and when the spring portion is pressed downwardly toward the top surface of the ski, and is substantially adjacent thereto, the legs are pressed inwardly toward each other, storing energy in the spring.

Thus, when ski brake 3 is in the braking position, arms 11 engage the inner edges of control surfaces 12 and are held in the position shown in FIG. 1. When the retaining stirrup 9 is pressed down by the ski boot and the brake arms 7 are pivoted into the neutral, non-braking position in which they are substantially parallel to and above the bottom surface of the ski, arms 11 move along the control surfaces and are forced inwardly, as shown in FIG. 2, or in the embodiment of FIG. 3, are forced outwardly, increasing the spacing between legs 11. In FIG. 2 where the supporting plate 4 has two control surfaces, the arms 11 are moved inwardly from a spacing identified as *c* by an amount *a* so that the spacing between the arms is decreased to a distance *b* in the neutral position of the brake arms shown in FIG. 2. According to the embodiment of FIG. 3, the original spacing *c* of stirrup arms 11 is increased by the amount *2a*. Due to the increase or decrease in the spacing of the arms, the retaining stirrup 9 is given a considerable additional tension so that a relatively large resilience is available for pivoting the brake arms 7 into the braking position.

It will be recognized that it is possible to omit one of the brake arms 7 in the construction of FIGS. 1 and 2, in which case only one control surface 12 would be provided. The configuration of the control surface 12 can also influence the characteristics of the resilience acting on the brake arm, for example, in that in the neutral position a relatively small resilience acts on the ski boot sole when the boot is in the ski binding and when the spring passes into the braking position, the effect of the resilience increases so that in the latter position there is a virtual positive locking whereby the brake arm 7 is securely held in place.

Due to the inwardly directed movement of stirrup arms 11, brake arms 7 are much closer to the longitudinal edge of the ski than in the braking position in the construction according to FIG. 2. As a result of this braking movement of brake arm 7 in the neutral position, the brake arm projects laterally much less than in the case of a ski brake without the lateral movement of the brake arm 7 at right angles to the longitudinal axis of the ski. Consequently, brake arm 7 can be provided with a relatively wide plate of, for example, plastic, which in the neutral position can even project inwardly somewhat over the longitudinal edge of the ski. As the ski boot sole is positioned somewhat higher corresponding to the height of supporting plate 4, the necessary space is available for brake arm 7.

Thus, it will be seen that the shape of control surface 12 is important because this leads not only to the transverse movement of brake arm 7 on passing from the braking into the neutral position, but also influences the force exerted by the resilience. It is advantageous if the retaining stirrup 9 has an initial tension in the braking position, i.e., that it is never permitted to be completely relaxed.

Control surface 12 can be provided with a notch-like recess 17, by means of which the brake arm 7 can be held in the braking position of FIG. 1 independently of the direction of movement of the ski.

Figure 6:
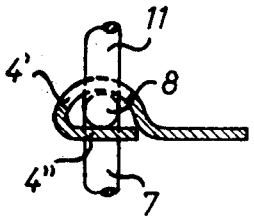
FIG. 6 is an enlarged side elevation, in section, of a further embodiment of a supporting plate.

If it is necessary or desirable, for example for reducing the risk of accidents, to permit the retaining stirrup to move back by a certain amount in the opposite direction to FIG. 1 relative to the neutral position on exceeding a particular stress, this can be accomplished in a simple manner if a control surface 12, 12' is provided for each direction of movement of retaining stirrup 9 as shown in FIGS. 4 and 6. The two control surfaces 12 and 12' form a recess in bearing portion 4' on whose base 17 the arms 11 of retaining stirrup 9 are guided in positive locked manner in the braking position.

It is important that with the two opposite control surfaces 12 and 12' retaining stirrup 9 and, consequently, brake arms 10, can be pivoted from the braking position in both directions. It is possible to give the two control surfaces 12 and 12' different shapes so that the resistance to pivoting differs depending upon the direction of movement. This is desirable because, normally, the ski brake is pivoted in only one direction from the braking position into the neutral position while the movement in the opposite direction should, for example, only occur when the brake arms strike against an obstacle. This leads to a reduction in the danger for the skier or third parties should the brake arm give way in the braking position.

Figure 5:
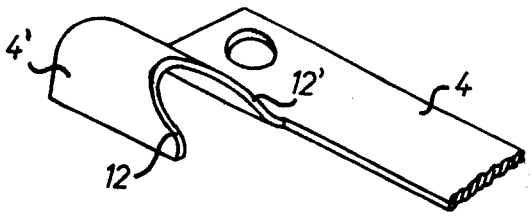
FIG. 5 is an enlarged perspective view of the supporting bracket plate of FIG. 4.

FIG. 5 shows in somewhat greater detail the shape of the recess formed by control surfaces 12 and 12'. As seen therein, each of the cam surfaces 12 and 12' is nonlinear and includes a portion adjacent the top surface of the ski which lies in a plane substantially parallel to the plane of the U-shaped member in the braking position.

If contact is not desired between pivot pins 8 and the top of the ski, the bearing portion or bracket 4' can be constructed as shown in FIG. 6 wherein it is provided with a tongue 4'' which extends between the top surface of the ski and pivot pin 8, the bracket itself forming the contact surface for the pivot pins. This construction also provides the possibility of pivoting arms 11 and consequently ski brake 3 completely into the neutral position on either side.

The elastic deformation of retaining stirrup 9 serving to form a resilience reserve, or energy storage member, can be further utilized to increase the braking area of brake arm 7 in the braking position, as can be seen in FIGS. 7 and 8. It will be recognized that, due to the arrangement of the brake arms on the sides of the ski, the braking area of each brake arm 7 cannot be selected to be excessively large because, otherwise, this would impede the skier. As shown in FIGS. 7 and 8, ski brake 3 is secured to the top 2 of ski 1 by means of supporting plate 4 and screws 5, generally as described with reference to FIGS. 1–3. As before, when brake arms 7 are pivoted into the braking position of FIG. 7, arms 11 of stirrup 9 slide on control surface 12 at the transition of arms 11 into pivot pins 8 so that the pins slide transversely with respect to the ski. Also as shown in FIG. 7, with each brake arm 7 is connected a second brake arm 14 which is pivotable with respect to brake arm 7 about a pivot pin 15 which is positioned near the upper end of each of brake arms 7. The second brake arms 14 are also provided with a second pivot 16 the spacing of which relative to the longitudinal axis of the ski remains unchanged, pivot 16 being movable when retaining stirrup 9 is pivoted. The two pivot pins 15 and 16 are parallel to one another. Since, when pivot pin 15 moves from the neutral position into the braking position of ski brake 3, the pivot pin is moved at right angles to the longitudinal axis of the ski, whereas the spacing of pivot pin 16 relative to the longitudinal axis of the ski remains unchanged, resulting in the pivoting of the second brake arm 14 about pivot pin 15. Pivot pin 16 is maintained in this spaced relationship relative to the longitudinal axis of the ski during the passage from the neutral position to the braking position by the interconnection of pivot pins 16 by a tie rod 17, the tie rod being guided by means of a guide plate 18 having a slot 19 in which a guidance member 20 protrudes, member 20 being connected to plate 4. It is possible to eliminate guidance means 18, 19 and 20 because guidance can take place along the lateral edges of the ski.

Pivot pins 15 and 16 can be rivets used to secure the pivotal connections between members 7 and 14 or 16 and 17. As shown in FIG. 7, the reciprocal positioning of pins 15 and 16 can be interchanged leading to a reversal of the pivoting direction. On the left-hand side of FIG. 7 the pivot pin 16 is located above pivot pin 15 and on the right-hand side the pivot pin 15 is located above pivot pin 16. Correspondingly, on the left-hand side of FIG. 7 the second brake arm 14 is pivoted outwardly and on the right-hand side inwardly. The particular solution which is adopted depends solely upon practical considerations. The same applies regarding the spacing between the two parallel pivoting pins 15 and 16 by which spacing the relative angular motion can be controlled.

If, as shown in the left-hand portion of FIG. 7, the swiveling angle of the second brake arm 14 is so large that a gap is formed, this gap can be filled by a flexible web or foil 21, a portion of which is fixedly attached to brake arm 7 and the other portion of which to brake arm 14. The braking area obtainable thereby is further increased by the provision of this web.

In FIG. 8, in which is shown the ski brake in its neutral position, the two brake arms 7 and 14 are precisely superimposed, brake arm 14 being located above brake arm 7. Tie rod 17 is positioned above retaining stirrup 9 but is secured in its lateral position by member 20 which projects into slot 19, the connection between member 20 and member 18 in the slot being a pivot connection.

As will be seen from this assembly, movement of the spring stirrup between the neutral and braking position causes lateral motion of pins 8 but tie rod 17 prevents such lateral motion, permitting the swiveling illustrated in FIG. 7.

While certain advantageous embodiments have been chosen to illustrate the invention, it will be understood by those skilled in the art that various changes and modifications can be made therein without departing from the scope of the invention as defined in the appended claims.

What is claimed is:

1. A ski brake for a ski of the type having a top surface and a longitudinal central axis, a bottom contact surface and a ski boot binding on the top surface, the brake comprising the combination of a brake arm;

a pivot pin fixedly attached to said brake arm and extending transversely relative to said ski;

bracket means mounted on the top surface of the ski for rotatably supporting said pivot pin, said pin being rotatable between a first position in which said brake arm is substantially parallel with and above the bottom contact surface of said ski and a second braking position in which said brake arm extends downwardly beyond said bottom surface;

resilient laterally deformable spring means connected to said pivot pin laterally relative to the central longitudinal axis of the ski, said spring means having a lever arm portion contactable by a ski boot in the binding, said lever arm portion being adjacent the top surface of the ski when said pivot pin is in said first position and which extends upwardly from said top surface when said pin is in said braking position; and means on said bracket means defining a cam surface having a slope relative to the axis of rotation of said pin for contacting said spring means to laterally deform said spring means when said pin and said brake arm are rotated toward said first position when a ski boot depresses said lever arm and to permit the lateral urging of said spring means to rotate said pin and arm toward said braking position when said lever arm is released.

2. A ski brake according to claim 1 wherein;

said spring means comprises a generally U-shaped resilient member having side legs and a central curved portion, the end of one of said side legs being connected to said pivot pin;

and wherein said cam surface acts against one of said legs to change the spacing between said legs during movement between said first and braking positions.

3. A ski brake according to claim 1 and further comprising a second brake arm; and a second pivot pin for supporting said second brake arm, and wherein said bracket means rotatably supports both of said pivot pins with said brake arms disposed at opposite sides of said ski;

said spring means is connected to both of said pivot pins for urging said pins outwardly, and said bracket means includes means defining a second cam surface having a slope relative to the axis of rotation of said pin for cooperating with said spring means to inwardly deform said spring means when said second pin and said second brake arm are rotated toward said first position when a ski boot depresses said lever arm and to permit the outward urging of said spring means to rotate said second pin and arm toward said braking position when said lever arm is released.

4. A ski brake according to claim 3 wherein said spring means comprises a generally U-shaped resilient member having side legs and a central curved portion, the ends of said side legs being connected to said pivot pins;

and wherein said cam surfaces act against respective ones of said legs to change the spacing between said legs during movements between said first and braking positions.

5. A ski brake according to claim 4 wherein each of said cam surfaces is nonlinear and includes a portion adjacent the top surface of the ski which lies in a plane substantially parallel to the plane of said U-shaped member in said braking position.

6. A ski brake according to claim 4 wherein said cam surfaces face in opposite directions to cause said U-shaped member to be under tension in said braking position.

7. A ski brake according to claim 4 wherein said cam surface includes a notch-like recess located to receive a portion of said resilient member to partially lock said member in said braking position.

8. A ski brake according to claim 4 wherein said pivot pins are further rotatable through said braking position toward a third position in which said brake arms are positioned approximately 180° from said first position, and wherein said bracket means further includes a third cam surface operatively associated with one of said legs of said spring means to resist movements of said brake arms toward said third position.

9. A ski brake according to claim 8 wherein said third surface has a different slope from said first and second surfaces.

10. A ski brake according to claim 4 and further comprising third and fourth brake arms pivotally connected to said first and second brake arms, respectively, for pivotal movement about axes substantially perpendicular to the axes of rotation of said pivot pins; and link means connected between said third and fourth arms and said bracket means for laterally displacing said third and fourth arms from said first and second arms as said arms move to said braking positions, thereby increasing the effective braking area of said arms.

11. A ski brake according to claim 10 wherein said link means comprises a tie rod connected between said third and fourth brake arms, and guide means for guiding the movement of said tie rod parallel with the longitudinal axis of the ski.

12. A ski brake according to claim 10 and further comprising first and second flexible webs, said first web extending between said first and third brake arms and said second web extending between said second and fourth brake arms.

13. A ski brake according to claim 1 and further comprising a second brake arm a second pivot pin connecting said second brake arm to said first brake arm, said second pivot pin having a pivot axis substantially perpendicular to and spaced from the axis of rotation of said first pivot pin;

a third pivot pin in said second brake arm spaced from and substantially parallel to said second pivot pin; and means connected to said third pivot pin and movable with said lever arm portion for establishing the spacing of said third pivot pin relative to the longitudinal axis of the ski independently of the position of said lever arm.

14. A ski brake according to claim 13 and further comprising a flexible web extending between said first and second brake arms.

* * * * *